US012303035B2

(12) United States Patent
Anderson et al.

(10) Patent No.: US 12,303,035 B2
(45) Date of Patent: May 20, 2025

(54) MULTILAYER MATTRESS ASSEMBLY AND MANUFACTURING PROCESS

(71) Applicant: DREAMWELL, LTD., Doraville, GA (US)

(72) Inventors: Brian Mark Anderson, Smyrna, GA (US); Sheri L. McGuire, Duluth, GA (US); Lindsey Beth Sidrane Sieber, Atlanta, GA (US); William James Andrews, III, Atlanta, GA (US)

(73) Assignee: DREAMWELL, LTD., Doraville, GA (US)

( * ) Notice: Subject to any disclaimer, the term of this patent is extended or adjusted under 35 U.S.C. 154(b) by 45 days.

(21) Appl. No.: 17/494,271

(22) Filed: Oct. 5, 2021

(65) Prior Publication Data

US 2023/0110050 A1 Apr. 13, 2023

(51) Int. Cl.
*A47C 27/00* (2006.01)
*A47C 27/15* (2006.01)

(52) U.S. Cl.
CPC ..... *A47C 27/001* (2013.01); *A47C 27/15* (2013.01)

(58) Field of Classification Search
CPC ..... A47C 27/001; A47C 27/15; A47C 27/002; A47C 21/022; A47C 27/056; A47C 27/06; A47C 27/12; A47G 9/0238; A47G 9/04
See application file for complete search history.

(56) References Cited

U.S. PATENT DOCUMENTS

| | | | | | |
|---|---|---|---|---|---|
| 1,742,064 | A * | 12/1929 | Dinstuhl | A47G 9/0238 | 5/498 |
| 2,923,014 | A * | 2/1960 | Hume | A47C 21/022 | 297/228.11 |
| 5,327,595 | A * | 7/1994 | Allen | A47C 21/022 | 24/72.5 |
| 5,557,813 | A * | 9/1996 | Steed | A47C 27/081 | 5/717 |
| 6,156,424 | A * | 12/2000 | Taylor | A61L 15/585 | 528/480 |
| 7,340,788 | B1 * | 3/2008 | Traub | A47C 27/002 | 5/923 |
| 10,433,651 | B2 * | 10/2019 | Smith | A61F 5/48 | |
| 2006/0048304 | A1 * | 3/2006 | Boyd | A47C 27/15 | 5/738 |
| 2020/0085200 | A1 * | 3/2020 | Engemann | A47C 21/022 | |
| 2020/0260881 | A1 * | 8/2020 | Deragon | A47C 21/022 | |
| 2022/0296002 | A1 * | 9/2022 | Long | A47C 27/056 | |

* cited by examiner

*Primary Examiner* — Justin C Mikowski
*Assistant Examiner* — Alison N Labarge
(74) *Attorney, Agent, or Firm* — CANTOR COLBURN LLP

(57) ABSTRACT

Multilayered mattress assemblies include at least one elongated elastic wrap compressively looped about at least two layers of the mattress assembly to maintain the at least two layers in a fixed relationship relative to one another.

18 Claims, 3 Drawing Sheets

MULTILAYER MATTRESS ASSEMBLY AND MANUFACTURING PROCESS

BACKGROUND

The present disclosure generally relates to multilayered mattress assemblies, and more particularly, to multilayered mattress assemblies and processes for manufacturing the multilayered mattress assemblies without the use of an adhesive. The multilayered mattress assemblies and processes of manufacturing generally include an elongated elastic wrap that is configured to wrap about and contain at least two layers of the mattress assembly in a fixed relationship relative to one another.

Current processes for manufacturing a multilayered mattress assembly generally include numerous steps utilizing manual labor including, among others, the utilization of adhesives between layers to maintain a fixed relationship relative to one another. For example, numerous mattress assemblies include stacked foam layers, wherein each overlaying foam layer is adhesively secured to an underlying foam layer to maintain a fixed relationship relative to one another. The application and use of adhesives, which are typically hot melt or water-based adhesives that require the use of special equipment, can be relatively expensive and are generally labor intensive because of the manually application of the adhesive. In those instances where application of the adhesive is automated, specialized equipment is required that adds expense to the assembly process.

The manual application of the adhesive required adhesion pressure and the like, as well as the use of specialized equipment can be difficult to uniformly control the application of adhesive, which can lead to inconsistent application of adhesive resulting in areas of low and high amounts of adhesive as well as waste. Due to a failure of any of the modes mentions, the layers can undesirably shift relative to one another resulting in visual negatives and poor fit. Still further, certain adhesives can emit volatile compounds that some end users or assemblers may find offensive. In addition to the challenges with application and use of adhesives in the manufacture of multilayered mattress assemblies, end of life recycling of mattress assemblies requires the separate removal of any adhesives that bad been used during construction, which adds expense, downgrade of material quality, and complicates the recycling process.

BRIEF SUMMARY

Disclosed herein is a mattress assembly including at least two or more layers in a stacked arrangement; and one or more elongated elastic wraps compressively looped about the at least two or more layers in the stacked arrangement to maintain the at least two or more layers in a fixed relationship to one another, wherein each of the one or more elongated wraps includes a first terminal end, a second terminal end, and a length therebetween sufficient to compressively loop about an entire perimeter defined by the at least two or more layers such that the first terminal end overlaps a portion of the elongated elastic wrap and is secured to the portion.

In one or more other embodiments, the mattress assembly includes a mattress body comprising one or more layers including a planar top surface; a side rail assembly disposed about a perimeter of at least a portion of the mattress body; and at least one elongated elastic wrap compressively looped about the side rail assembly to maintain the side rail assembly in fixed relationship relative to the mattress body.

The disclosure may be understood more readily by reference to the following detailed description of the various features of the disclosure and the examples included therein.

BRIEF DESCRIPTION OF THE DRAWINGS

Example embodiments of the invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout, and wherein.

Figure

DETAILED DESCRIPTION

Figure 1:
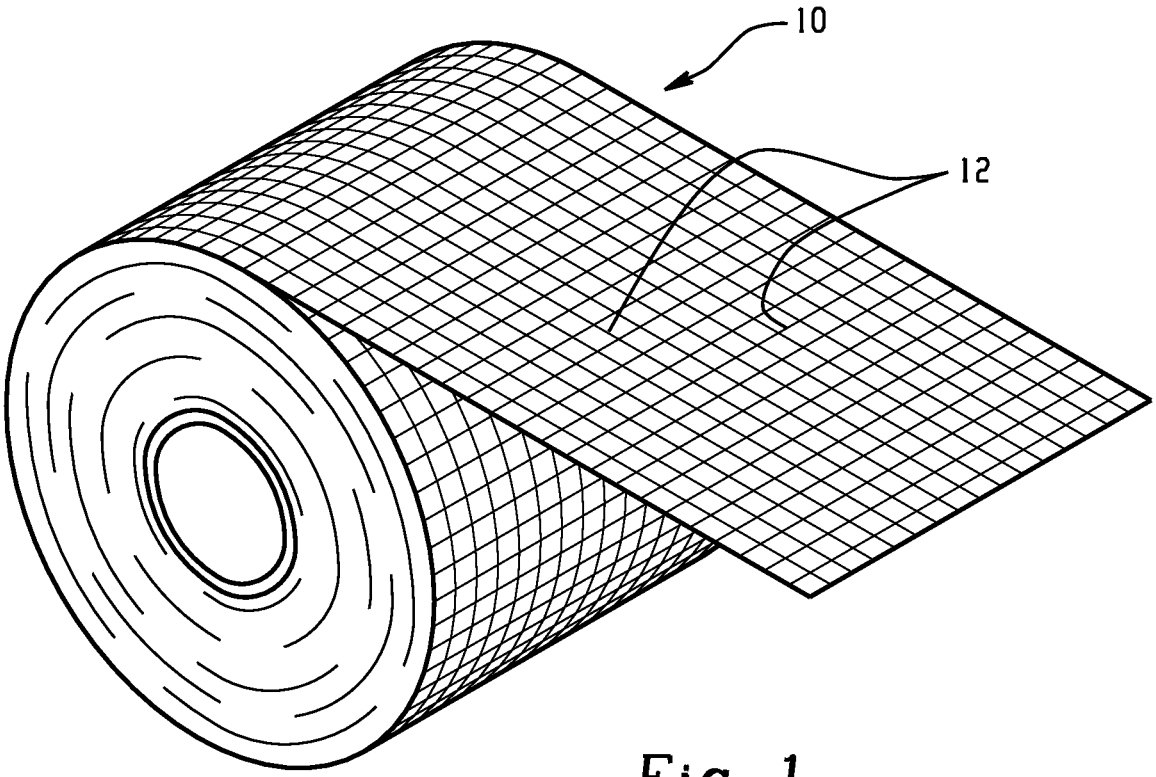
(FIG. 1 illustrates a perspective view of an elongated elastic wrap in accordance with an embodiment of the present disclosure.

Disclosed herein are mattress assemblies and manufacturing processes that generally utilize an elongated elastic wrap that is configured to wrap about and compressively contain at least two of the multiple layers of the mattress assembly in a fixed relationship relative to one another. The at least two layers can be stackedly arranged to define at least a portion of the mattress assemblies and/or can include side rail assemblies that are provided about at least a portion of a perimeter of the mattress assembly. The optional side rails assemblies are generally utilized to provide the end user with increased firmness relative to the mattress body to allow ease of ingress and egress to the mattress so as to avoid a sinking sensation.

The elongated elastic wrap can be compressively wrapped about the two more layers to maintain the two or more layers in a fixed relationship relative to one another without the use of an adhesive. In one or more embodiments, the elongated elastic wrap is a self-adherent elongated elastic wrap, wherein an end of the wrap is configured to overlay and self-adhere to a portion of the wrap. In other embodiments, the elongated elastic wrap can be mechanically secured to itself using a mechanical fastener without the use of an adhesive, e.g., using a threaded engagement (sewn), stapled, hook and loop fasteners, clipped, or the like. In one or more other embodiments, the elongated wrap is a continuous elastic loop that can be initially stretched to accommodate a dimension of the at least two layers and then left in a relaxed state having dimensions effective to compressively maintain the at least two layers in the fixed relationship. The elongated wrap can be configured in the x-, y- and/or z-directions.

Advantageously, the elongated elastic wrap can be used in place of an adhesive for at least the two layers being compressively wrapped, which can overcome many of the problems noted in the prior art by reducing cost and complexity associated with the manufacture of a mattress assembly. Moreover, the elongated elastic wrap can be strategically located within the mattress to provide end user benefits such as, for example, increased firmness so as to enhance spinal alignment or pressure relief, e.g., the presence of the elongated elastic wrap could be compressively looped about at least the two upper layers corresponding to the lumbar region to increase mattress firmness within this zone. Likewise, other locations can be strategically to correspond to other regions or portions of an end users body position during a sleep cycle. The particular locations of the elongated elastic wrap are not intended to be limited.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Referring now to FIG. 1, there is depicted a perspective view of an elongated elastic wrap in accordance with one or more embodiments, which is generally designated by reference numeral 10. The elongated elastic wrap 10 generally includes a plurality of elastic fibers 12 bound together to provide the elongated wrap and optionally a polymer binder thereon to provide cohesion, i.e., self-adherence when in contact with itself. The elastic fibers can be woven, non-woven, knitted or the like to form an elongated elastic wrap in a manner as is generally known in the art. The elastic fibers 12 can be optionally coated or impregnated with the polymer binder during manufacture thereof.

The width of the elongated elastic wrap 10 is not intended to be limited so long as the wrap can be compressively looped about two or more abutting layers within a mattress assembly. For ease in handling during the manufacture of the mattress assembly, in one or more embodiments, the elongated elastic wrap can have a width greater than 2 inches. In other embodiments, the width of the elongated elastic wrap can be greater than 4 inches, and in still other embodiments, the width of the elongated elastic wrap can be greater than 6 inches. The elongated elastic wrap can be wrapped one or more times about the two or more layers within the mattress assembly and can be provided at different locations about the mattress assembly to maintain a fixed relationship between the different layers. Maximal thickness is generally dictated by the length and width dimension of the mattress assembly itself and the orientation of the loops of the elongated elastic wrap relative to the length of width of the mattress assembly. Generally, the maximum width of the elongated elastic wrap is a fraction of the width or length of the mattress assembly being assembled depending on the orientation of the elongated elastic wrap. Mattress assemblies are typically rectangularly shaped and the loops of the elongated elastic wrap can be transverse with respect to the length and/or can be compressively looped along the longitudinal length of the mattress assembly.

The elongated elastic fibers can be formed of synthetic fibers, natural fibers, or mixtures thereof. Synthetic fibers are not intended to be limited and can include, for example, polyester, acrylic, polyamide, polyolefin, polyaramid, polyurethane, regenerated cellulose (i.e., rayon), cellulose derivatives, and blends thereof. Natural fibers can include, for example, wool, cotton, flax, bamboo, and blends thereof. The fiber may include additives such as fire retardant (FR) solutions or other end user benefit compounds.

Suitable polymeric binders providing self-adherent properties may be either elastomeric or non-elastomeric polymeric binders. In one or more embodiments, the polymeric binder is an elastomeric polymeric binder and is selected to provide long-term flexibility, extensibility and/or elasticity. Suitable elastomeric polymeric binders may include natural rubber latex, a synthetic latex, such as homopolymer and copolymer latexes of acrylics, butadienes, styrene/butadiene rubbers, chloroprenes, ethylenes (e.g., vinyl acetate/ethylene), isoprenes, nitriles and urethanes, or mixtures thereof. Examples of suitable polymeric elastomeric binders are disclosed for example in U.S. Pat. Nos. 3,575,782; 4,984,585; and 6,156,424 as well as in textbooks, such as Neoprene Latex: Principles of Compounding and Processing, J. C. Carl, 1962, Delaware, E. I: DuPont de Nemours (e.g., under the section entitled Contact Bond Adhesives, on page 100) and Handbook of Adhesives 3$^{rd}$ Edition, Ed. I. Skeist, 1990, New York, Van Nostrand Reinhold (e.g., page 305).

The elongated elastic wrap 10 is adapted to provide a compressive force when looped and secured to itself about the two or more layers of the mattress assembly, i.e., the elongated elastic wrap is compressively looped about the two or more layers with one end of the wrap overlapping and mechanically and/or self-adherently secured to an underlying portion of the wrap. The extent of compression provided is generally related to, inter alia, size of the elastic fibers, and the number of fibers per unit area, whereby increased compression is typically a result of using greater number of larger elastic fibers in the wrap.

Examples of suitable types of elastomeric wraps as well as methods of making such wraps are disclosed in U.S. Pat. Nos. 3,575,782; 4,984,584; 6,156,424; and 8,403,873, the contents of which are incorporated in their entirety herein by reference. Other examples of suitable types of self-adherent bandages includes knitted and woven wraps commercially available under the trade name CoFlex by Milliken or other similar fabrics.

Figure 2:
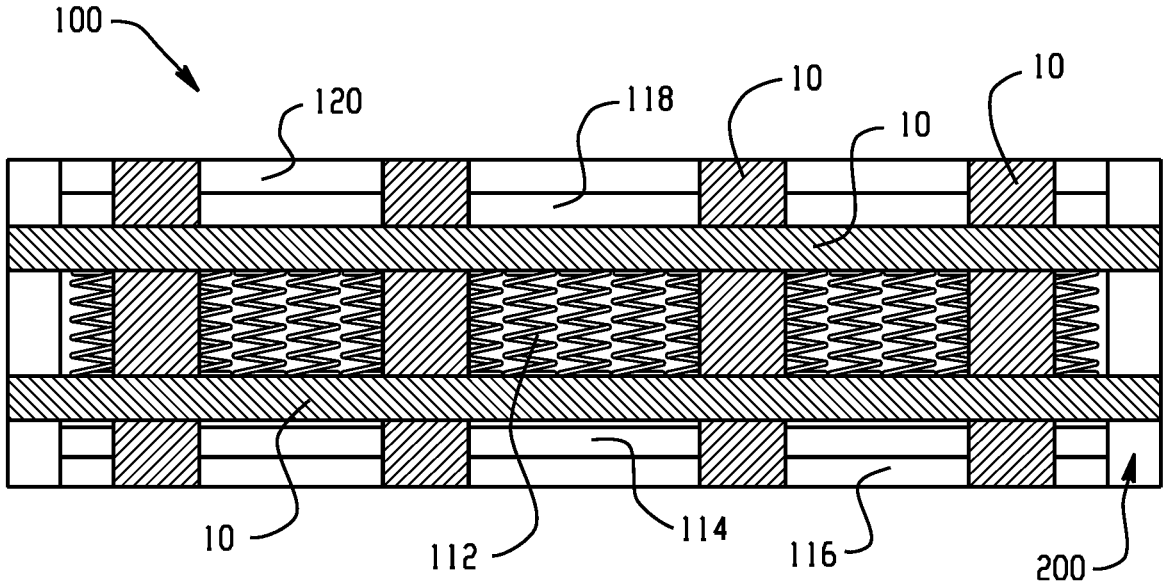
FIG. 2 illustrates a cross-sectional view of an exemplary mattress assembly including multiple layers in a fixed relationship utilizing the elongated elastic wrap in accordance with an embodiment of the present disclosure.
Figure 3:
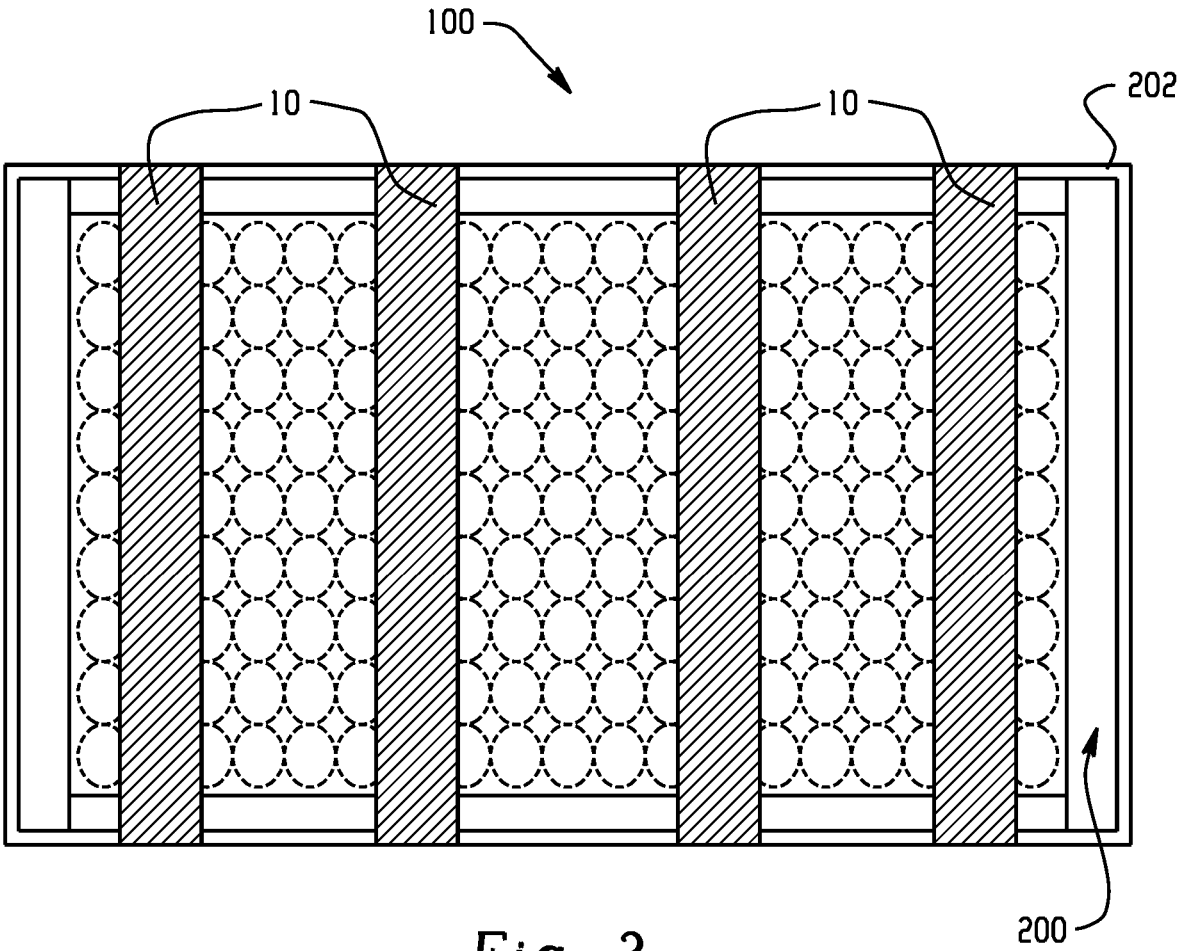
FIG. 3 illustrates a top-down view of the exemplary mattress assembly of FIG. 2 in accordance with an embodiment of the present disclosure.

Turning now to FIGS. 2 and 3, there are depicted cross-sectional and top-down views of an exemplary mattress assembly 100 including at least five layers compressively restrained using the elongated elastic wrap in accordance with the present disclosure. The different layers depicted in the mattress assembly are not intended to be limited to any particular material. Any variations thereof may be manufactured using techniques known in the art of mattress making, with variations to achieve a mattress assembly including at least two layers compressively restrained in a fixed relationship relative to one another using the elongated elastic wrap 10.

The illustrated exemplary mattress assembly is a hybrid mattress assembly 100 including a plurality of layers and a side rail assembly disposed about a perimeter of the mattress assembly. The depicted plurality of layers include at least one coil spring layer 112 sandwiched between foam layers 114, 116, 118, and 120 of any type of foam as may be desired to attain a desired mattress assembly thickness. Although four foam layers are depicted, more or less layers can be employed, which may or not be foam including coil layers, fibers layers, and the like. Moreover, the thicknesses of the various foam layers can vary and are generally from about V/2 inch in thickness to about 12 inches or less in thickness. The uppermost layer 120 is generally referred to herein as the cover layer and has a planar top surface adapted to substantially face the user resting on the mattress assembly and having a length and width dimensions sufficient to support a reclining body of the user.

The coil layer 112 generally includes coil springs that are not intended to be limited to any specific type or shape. The coil springs can be single stranded or multi-stranded, pocketed or not pocketed, asymmetric or symmetric, and the like. It will be appreciated that the pocketed coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

Suitable foam layers include, without limitation, synthetic and natural latex, polyurethane, polyethylene, polypropylene, and the like. Optionally, in some embodiments, one or more of the foam layers may be pre-stressed such as is disclosed in U.S. Pat. Pub. No. 2010/0072676, incorporated herein by reference in its entirety.

In one or more embodiments, the mattress assembly can be assembled using the elongated elastic wrap in combination with other types of mechanical fasteners to provide an adhesive-free mattress assembly.

As shown more clearly in FIG. 3, the side rail assembly 200 is disposed about the perimeter of the layers described above. The illustrated side rail assembly is provided about a perimeter of the stacked mattress layers, and an optional fabric covering 202 about the side rail assembly 100 as shown, i.e., mattress border. The side rail assembly can be formed of a single layer or multiple layers including foam layers, fiber layers, coil layers, and combinations thereof.

It should be apparent that the elongated elastic wrap 10 can be utilized with a variety of mattress assemblies including, but not limited to, mattress assemblies including all foam layers, bed in the box type foam mattress assemblies, hybrid mattress assemblies including multiple coil layers as well as mattress assemblies without a side rail assembly. Likewise, the elongated elastic wrap can be configured such that it is compressively looped about the top, side and bottom surfaces as is generally shown in FIGS. 2 and 3 and/or can be compressively looped about the sidewall of the mattress assembly such as may be beneficial in mattress assemblies including a side rail assembly. Moreover, the variations of the mattress assembly suitable for use in the present disclosure can have more or less layers than that shown. These mattress assembly variations can further include any materials used in mattress constructions, including, for example, batting layers, waterproof liners, air bladders, phase change materials, specialty foams such as viscoelastic foams, and so forth. The mattress assemblies including the elongated elastic wrap such as that described above may include other layers adjoined to one another using an adhesive and/or thermally bonding and/or may be mechanically fasteners e.g., hog rings, staples, and/or other techniques known in the art.

Figure 4:
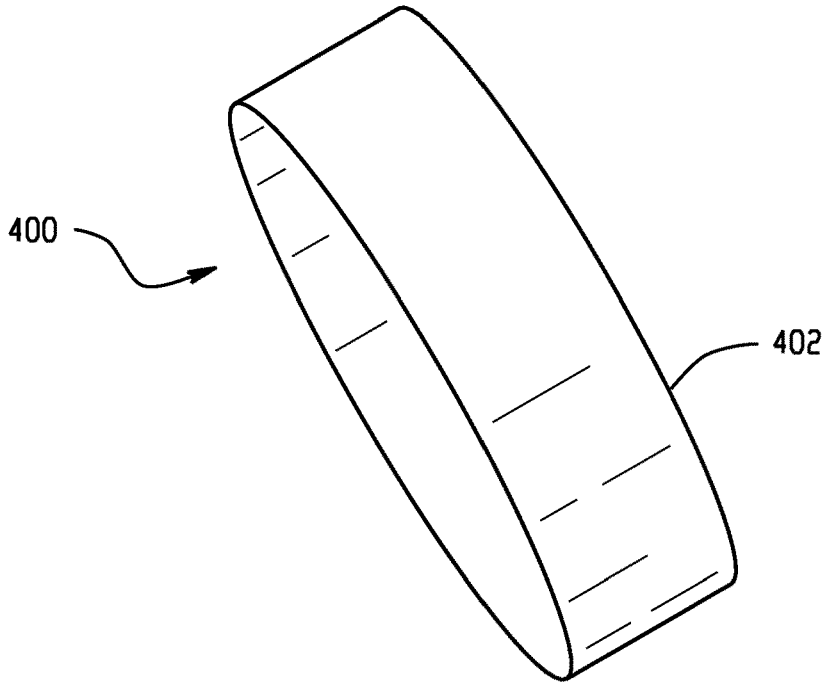
FIG. 4 illustrates a perspective view of a continuous loop of an elongated elastic wrap in accordance with an embodiment of the present disclosure.
Figure 5:
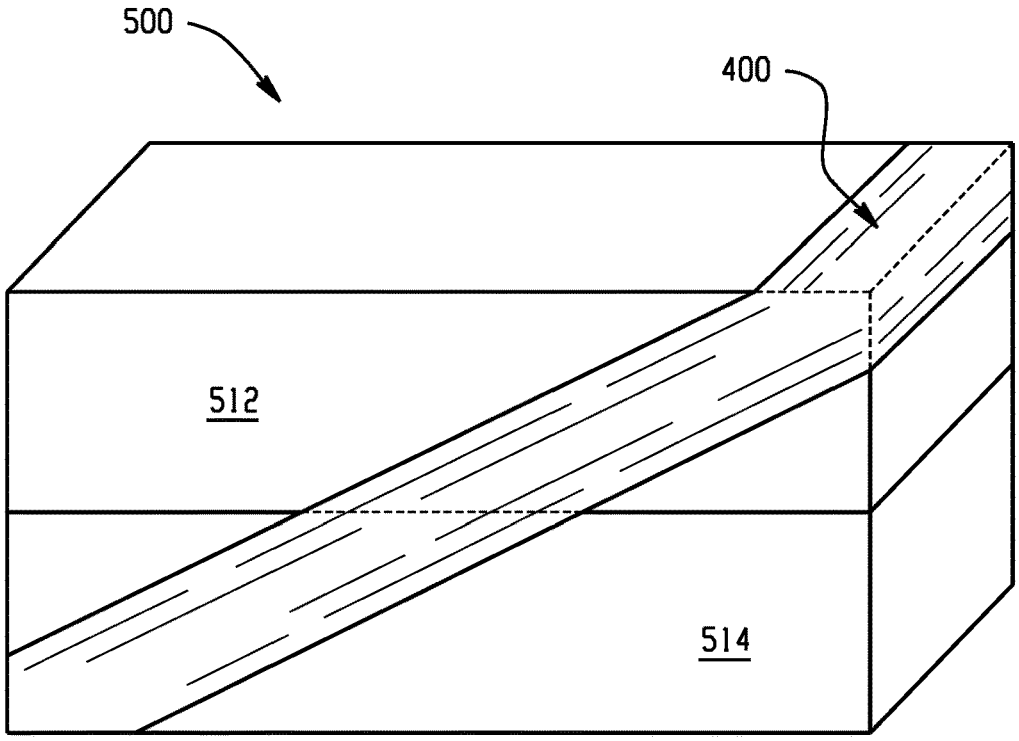
FIG. 5 illustrates a cross-sectional view of at least two layers in a mattress assembly maintained in a fixed relationship utilizing a continuous loop of the elongated elastic wrap in accordance with an embodiment of the present disclosure.

Turning now to FIG. 4, there is depicted a continuous loop of an elongated wrap, generally designated by reference numeral 400, formed of an elastic material 402 such as rubber or an elastomer. As shown in the mattress assembly 500 including at least two layers 512, 514, one or more of the continuous loops of the elongated wrap 400 can be wrapped about the two layers 512, 514 (one of which is shown) to maintain these layers in a fixed relationship relative to one another without the application of an adhesive. The single continuous loop of the elongated wrap 400 extends in a z-direction to compressive restrain the layers 512, 514 and maintain the fixed relationship. The continuous loop of the elongated wrap 400 can be used in any or multiple directions, i.e. the x-, y-, and/or z-directions. Additionally, it should be apparent that additional continuous and/or discontinuous can be used in any direction. This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly, comprising:

at least two or more layers in a stacked arrangement free of adhesive, wherein the stacked arrangement of the at least two or more layers have an upper major planar exterior surface and a lower major planar exterior surface, and sidewalls extending between the upper and lower planar surfaces defining a height dimension;

a fabric covering encapsulating the stacked arrangement; and two or more elongated elastic wraps compressively looped about the fabric covering to maintain the at least two or more layers in a fixed relationship to one another, wherein each of the two or more elongated wraps includes a first terminal end, a second terminal end, a length therebetween sufficient to loop about an entire perimeter defined by the at least two or more layers encapsulated within the fabric covering such that the first terminal end overlaps a portion of the elongated elastic wrap and is secured to the portion, and a constant width from the first terminal end to the second terminal end, wherein the constant width of the two or more elongated elastic wraps is a fraction of a width dimension of the upper or lower major planar exterior surfaces and/or a fraction of the sidewall height dimension, wherein the two or more elongated elastic wraps are in direct contact with only the fabric covering encapsulating the stacked arrangement of the at least two layers and are not attached to the fabric covering, and wherein the two or more elongated wraps are compressively arranged in at least two different directions.

2. The mattress assembly of claim 1, wherein each of the at least two elongated elastic wraps comprise a plurality of elastomeric fibers.

3. The mattress assembly of claim 2, wherein each of the at least two elongated elastic wraps further comprise a polymer binder coated onto or infused into elastomeric fibers such that the first terminal end self-adheres to the overlapped portion of the elongated elastic wrap.

4. The mattress assembly of claim 1, wherein the mattress assembly is rectangularly shaped having a length dimension and a width dimension, and wherein the at least two elongated elastic wraps are looped about the length dimension and transverse to the length dimension.

5. The mattress assembly of claim 1, wherein the first terminal end is mechanically fastened to the portion of the elongated elastic wrap.

6. The mattress assembly of claim 1, wherein the two or more elongated elastic wraps are compressively looped about a region of the mattress assembly to provide an increase in firmness relative to other regions without the elongated elastic wrap.

7. The mattress assembly of claim 1, wherein the at least two or more layers in the stacked arrangement define at least a portion of a side rail assembly disposed about at least a portion of a perimeter of the mattress assembly.

8. The mattress assembly of claim 1, wherein the at least two or more layers define an entire thickness of the mattress assembly.

9. The mattress assembly of claim 1, wherein the at least two or more layers define a portion of a thickness of the mattress assembly.

10. A mattress assembly comprising:

a mattress body comprising one or more stackedly arranged layers including a planar top exterior surface and a planar bottom exterior surface;

a side rail assembly disposed about a perimeter of at least a portion of the mattress body;

a fabric covering encapsulating the mattress body and the side rail assembly; and at least two elongated elastic wraps compressively looped about the mattress body in at least two directions configured to maintain the side rail assembly and the mattress body comprising the one or more stackedly arranged layers in fixed relationship relative to the mattress body, wherein the at least two elongated elastic wraps is in direct contact with only the fabric covering encapsulating the mattress body and the side rail assembly, wherein each of the at least two elongated wraps includes a first terminal end, a second terminal end, a length therebetween sufficient to loop about an entire perimeter defined by the at least two or more layers such that the first terminal end overlaps a portion of the elongated elastic wrap and is secured to the portion, and a constant width from the first terminal end to the second terminal end, wherein the constant width for each of the two or more elongated elastic wraps is a fraction of a width dimension of the top or bottom planar exterior surfaces and/or a fraction of a height dimension for the side rail assembly.

11. The mattress assembly of claim 10, wherein each of the at least two elongated elastic wraps are parallel to ground level and contacts sidewalls defined by the siderail assembly and vertical to the mattress body.

12. The mattress assembly of claim 10, wherein the side rail assembly comprises multiple stackedly arranged layers, and wherein at least one of the two elongated elastic wraps is compressively looped about the multiple stackedly arranged layers to maintain the stackedly arranged layers in a fixed relationship relative to one another.

13. The mattress assembly of claim 10, wherein the elongated elastic wrap comprises a plurality of elastomeric fibers.

14. The mattress assembly of claim 13, wherein the elongated elastic wrap further comprises a polymer binder coated onto or infused into elastomeric fibers such that the first terminal end self-adheres to the overlapped portion of the elongated elastic wrap.

15. The mattress assembly of claim 10, wherein the mattress assembly is adhesive-free.

16. The mattress assembly of claim 10, wherein the first terminal end is mechanically fastened to the portion of the elongated elastic wrap.

17. The mattress assembly of claim 10, wherein the at least two elongated elastic wraps are each a continuous loop.

18. The mattress assembly of claim 10, wherein the at least two elongated elastic wraps are extended at least two directions selected from an x-direction, a y-direction, and/or a z-direction.

* * * * *